US007497741B2

(12) United States Patent
Cai et al.

(10) Patent No.: US 7,497,741 B2
(45) Date of Patent: Mar. 3, 2009

(54) MULTI-LAYERED CONNECTOR

(75) Inventors: Qing Cai, Guangdong (CN); Chih-Chuan Chen, Guangdong (CN); Ming-Chih Chan, Guangdong (CN); Xiao-Qin Jiang, Guangdong (CN)

(73) Assignees: Hong Fu Jin Precision Industry (Shen Zhen) Co., Ltd., Longhua Town, Bao'an District, Shenzhen, Quangdong Province; Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/753,580

(22) Filed: May 25, 2007

(65) Prior Publication Data

US 2008/0045046 A1 Feb. 21, 2008

(30) Foreign Application Priority Data

Aug. 18, 2006 (CN) ..... 2006 2 0200717 U

(51) Int. Cl.
*H01R 12/00* (2006.01)

(52) U.S. Cl. ..... 439/701; 439/238

(58) Field of Classification Search ..... 439/701, 439/328, 327, 238

See application file for complete search history.

(56) References Cited

U.S. PATENT DOCUMENTS

| | | | | | |
|---|---|---|---|---|---|
| 4,703,990 | A * | 11/1987 | Assmann et al. | ..... | 439/404 |
| 5,190,472 | A * | 3/1993 | Voltz et al. | ..... | 439/579 |
| 5,895,280 | A * | 4/1999 | Buss et al. | ..... | 439/271 |
| 6,146,151 | A * | 11/2000 | Li | ..... | 439/66 |
| 6,290,550 | B1 * | 9/2001 | Lomastro et al. | ..... | 439/723 |
| 6,679,734 | B2 * | 1/2004 | Lomastro et al. | ..... | 439/723 |
| 7,189,098 | B1 * | 3/2007 | Wu | ..... | 439/352 |

* cited by examiner

*Primary Examiner*—Gary F. Paumen
(74) *Attorney, Agent, or Firm*—Winston Hsu

(57) ABSTRACT

A multi-layered connector is disclosed. The multi-layered connector includes a first sub-connector and a second sub-connector. The first sub-connector includes a first elongated body. The second sub-connector includes a second elongated body, and two side arms elongated upwardly from opposite ends of the second elongated body. The side arms define slide grooves faced to each other for receiving the first sub-connector. The multi-layered connector further includes glue points that connect the first elongated body and the second elongated body. The multi-layered connector avoids solder bridges and solder cracks.

3 Claims, 8 Drawing Sheets

MULTI-LAYERED CONNECTOR

BACKGROUND

1. Technical Field

The present invention relates to a connector.

2. General Background

Ball grid array (BGA) type multi-layered connectors are widely used in computers. The multi-layered connector includes a first sub-connector and a second sub-connector stacked together. Each sub-connector includes an elongated body. The second sub-connector includes two side arms elongated upwardly from two ends of the body of the second sub-connector. Each side arm defines a slide groove for receiving the first sub-connector. Engaging protrusions and recesses are positioned in the slide groove and two ends of the first sub-connector for fixing the first and second sub-connector. Tin balls are disposed on the elongated bodies and are soldered to a PCB (printed circuit board).

Solder bridges often appear when the multi-layered connector is soldered to the PCB, and solder cracks often appear when a semiconductor chip is inserted into or pull out from the first sub-connector, thus causing the multi-layered connector to become useless.

Therefore, what is needed is a multi-layered connector avoiding solder bridges and solder cracks.

SUMMARY

An multi-layered connector is disclosed. The multi-layered connector includes a first sub-connector and a second sub-connector. The first sub-connector includes a first elongated body. The second sub-connector includes a second elongated body, and two side arms elongated upwardly from opposite ends of the second elongated body. The side arms define slide grooves faced to each other for receiving the first sub-connector. The multi-layered connector further includes glue points that connect the first elongated body and the second elongated body.

Sub-connectors of traditional multi-layered connector only connects to each other on two ends. When the multi-layered connector is soldered to a PCB in high temperature, the elongated bodies are deformed relative to each other, causing solder bridges. When a semiconductor chip is inserted into or pull off from the first sub-connector, stress concentration occurs at two ends and causes solder cracks.

Yet, the elongated bodies of the sub-connectors of the present invention connects to each other by glue points. When the multi-layered connector is soldered to a PCB, the deformation of the elongated bodies relative to each other are restricted by the connections of glue points, thus the solder bridges are avoided. When a semiconductor chip is inserted into or pull of from the first sub-connector, stress is dispersed at the glue points, thus the solder cracks are avoided.

Further features and advantages will be provided or will become apparent in the course of the following detailed description.

DETAILED DESCRIPTION OF THE EMBODIMENT

Figure 1:
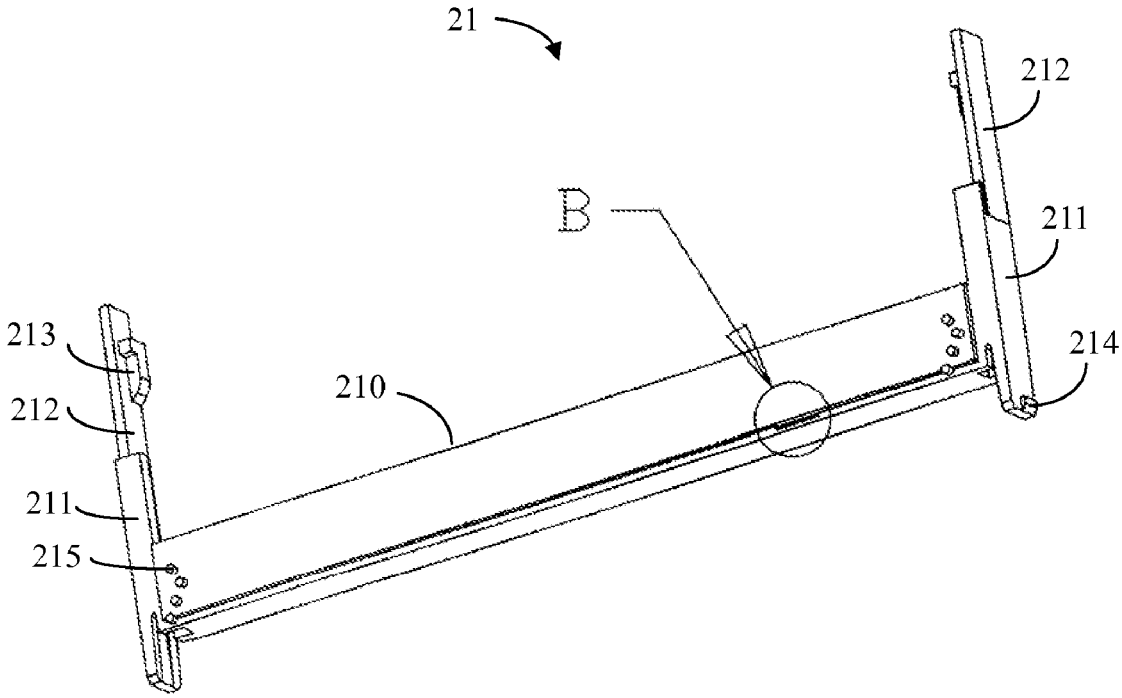
FIG. 1 is a schematic, isometric view of a first sub-connector of a multi-layered connector according to a first embodiment of the present invention.
Figure 2:
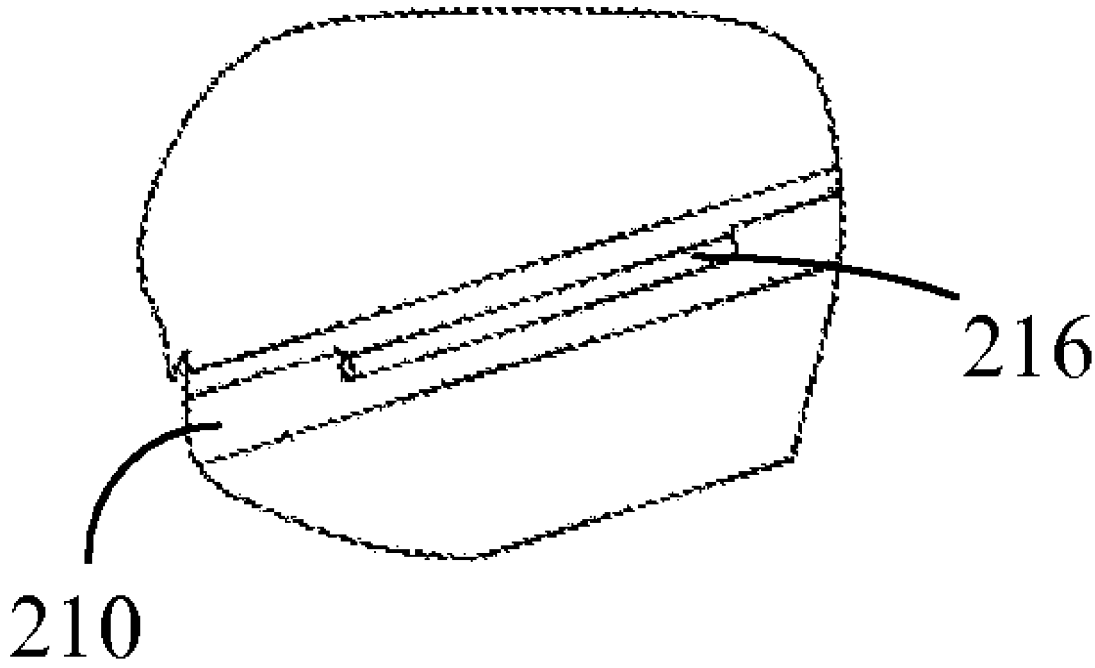
FIG. 2 is a schematic, enlarged view of a B part of the first sub-connector of FIG. 1.
Figure 7:
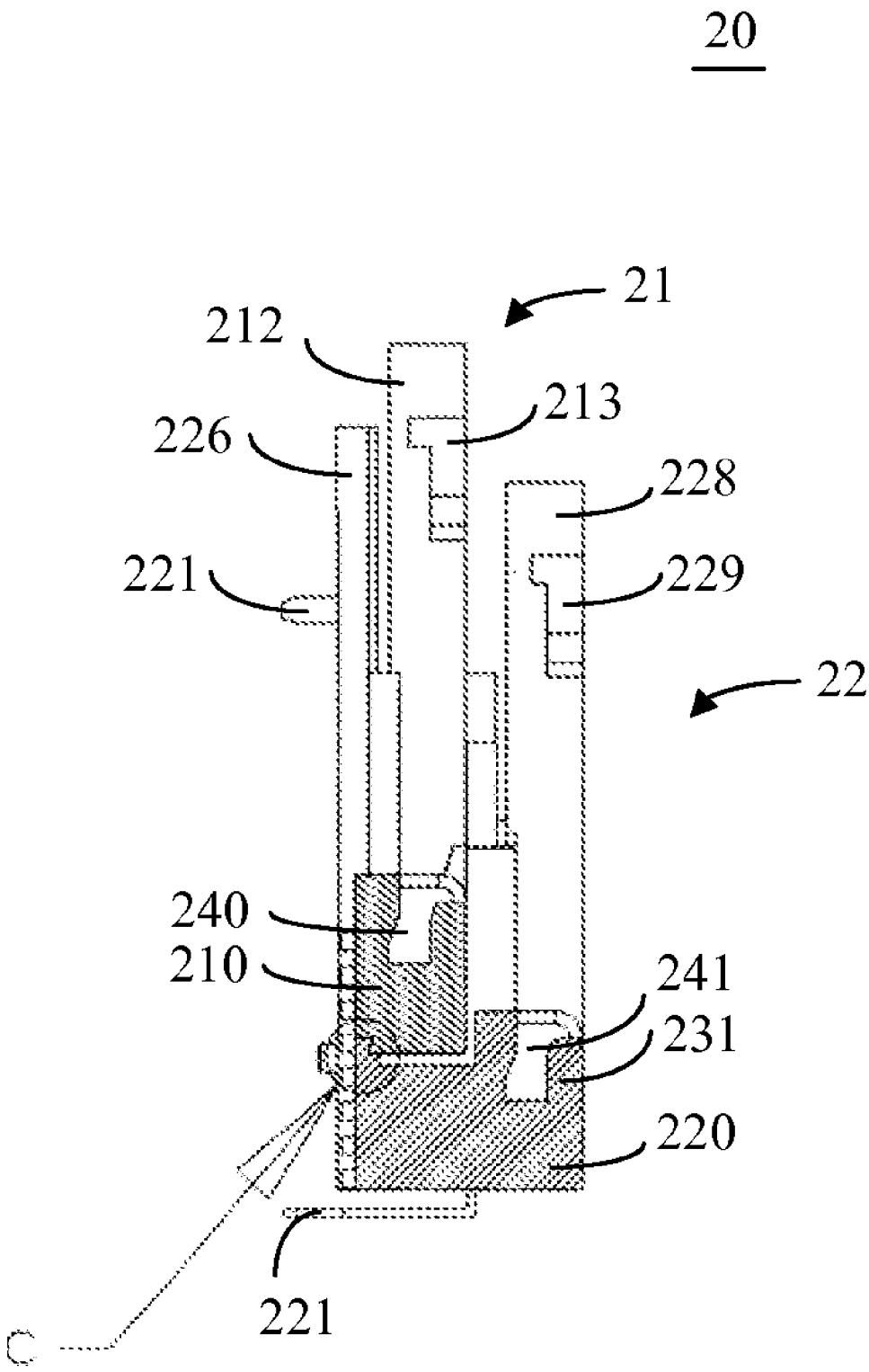
FIG. 7 is a schematic, section view of the multi-layered connector of FIG. 6.
Figure 8:
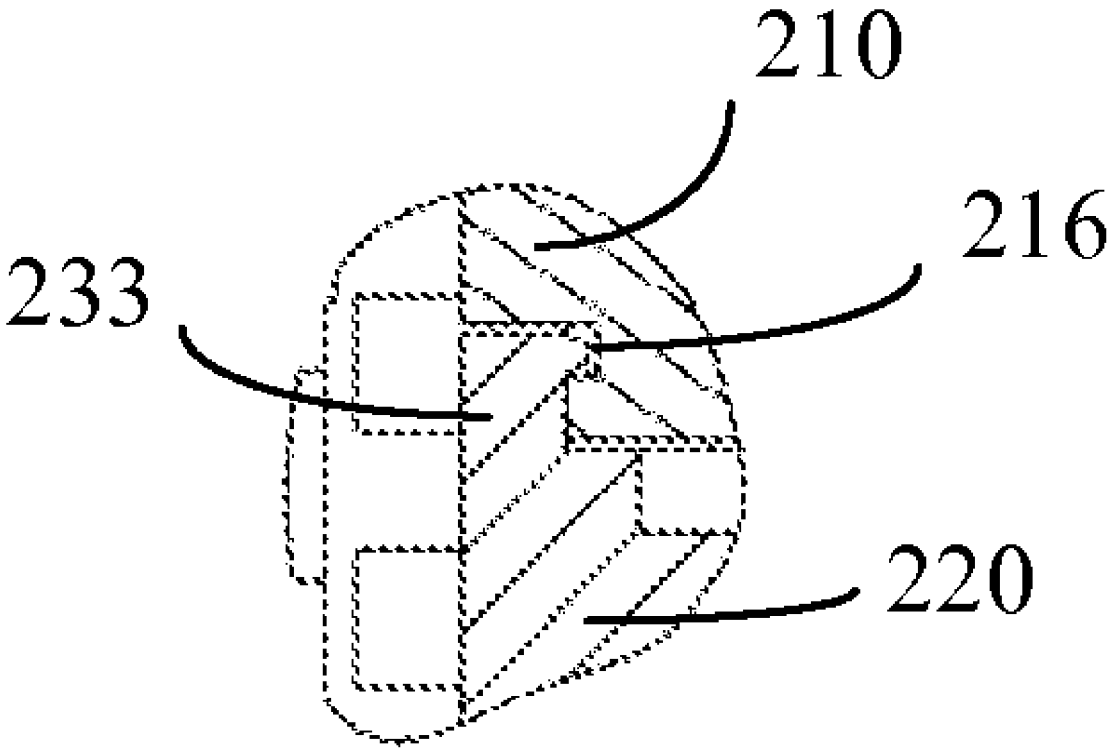
FIG. 8 is a schematic, enlarged view of a C part of the multi-layered connector of FIG. 7.

Referring to FIGS. 1 and 2, a first sub-connector 21 of a multi-layered connector according to a first embodiment of the present invention is disclosed. The first sub-connector 21 includes an elongated body 210 and two side arms 211, each vertically elongated from opposite ends of the body 210 correspondingly. The body 210 defines an elongated slot 240 (See FIG. 7) on a top surface for receiving a first semiconductor chip (not shown). A plurality of tin microstructures 215 are mounted on a front surface of the body 210. The body 210 further defines a recess 216 adjacent a bottom edge of the front surface. Each side arm 211 defines a protrusion 214 on an outer bottom end. An elastic piece 212 is elongated upwardly from an upper end of each side arm 211. Each elastic piece 212 includes an "L"-shaped clip 213 on an inner surface of the elastic piece 212. The two clips 213 are faced to each other. The slot 240, side arms 211, elastic pieces 212, and clips 213 are configured for holding the first semiconductor chip.

Figure 3:
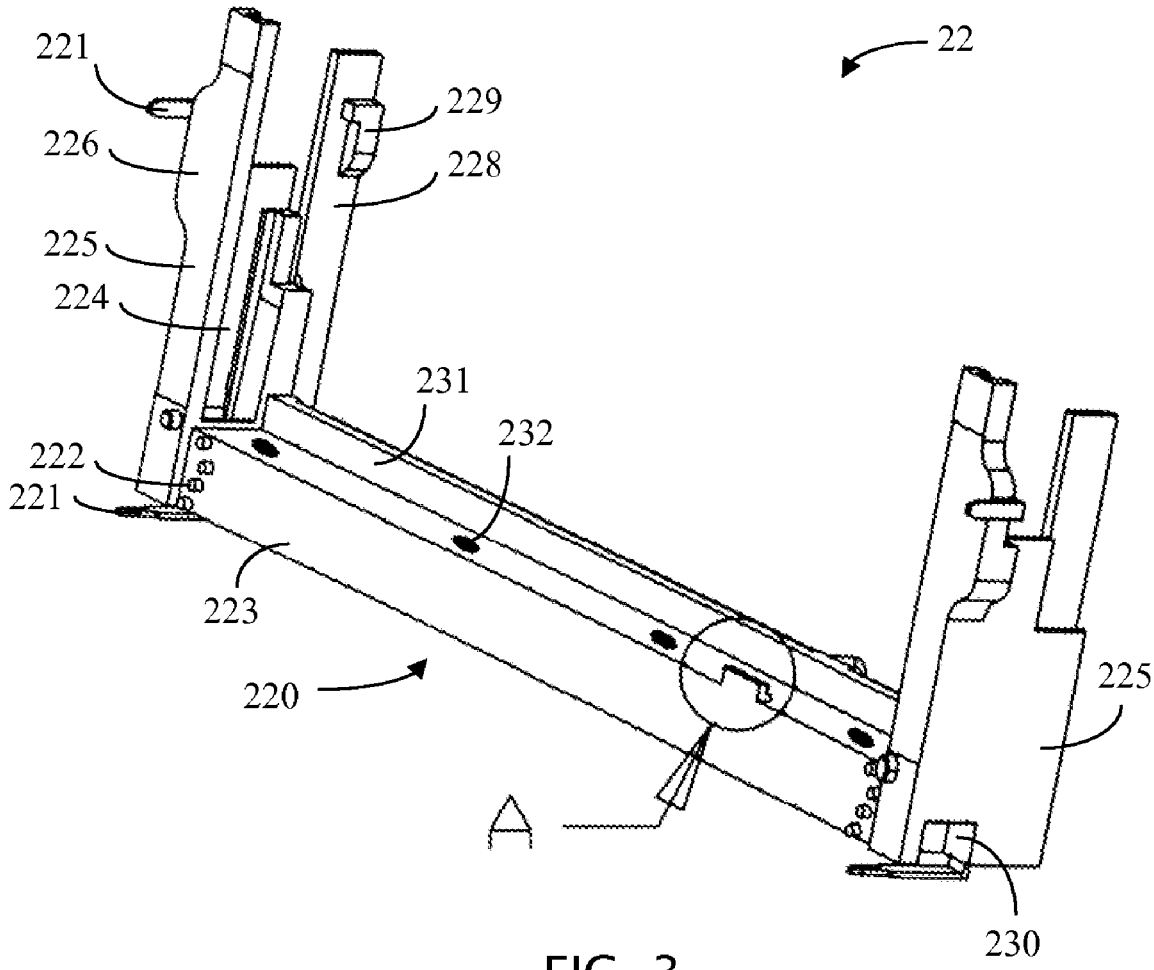
FIG. 3 is a schematic, isometric view of a second-sub connector of the multi-layered connector.
Figure 4:
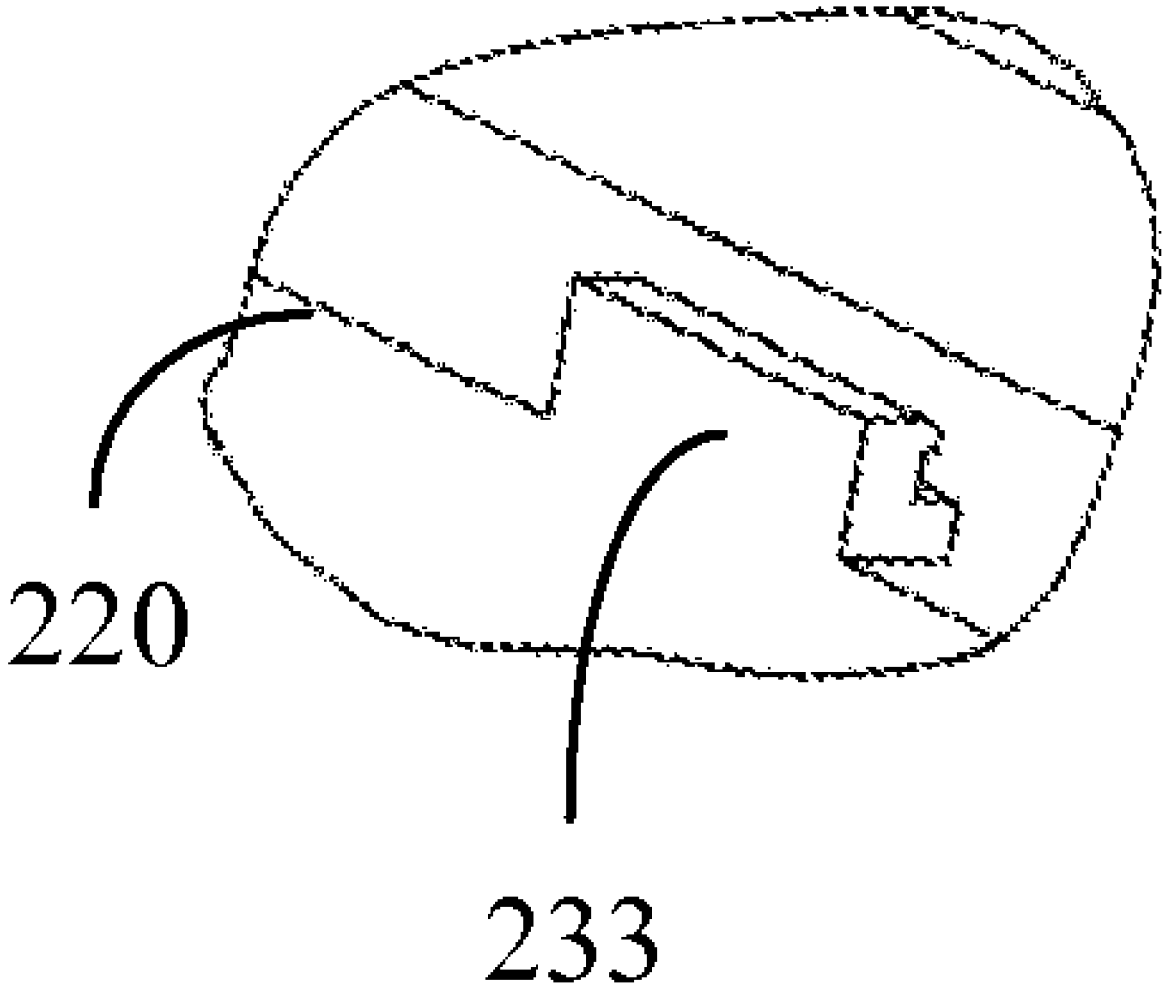
FIG. 4 is a schematic, enlarged view of a A part of the second-sub connector of FIG. 3.
Figure 5:
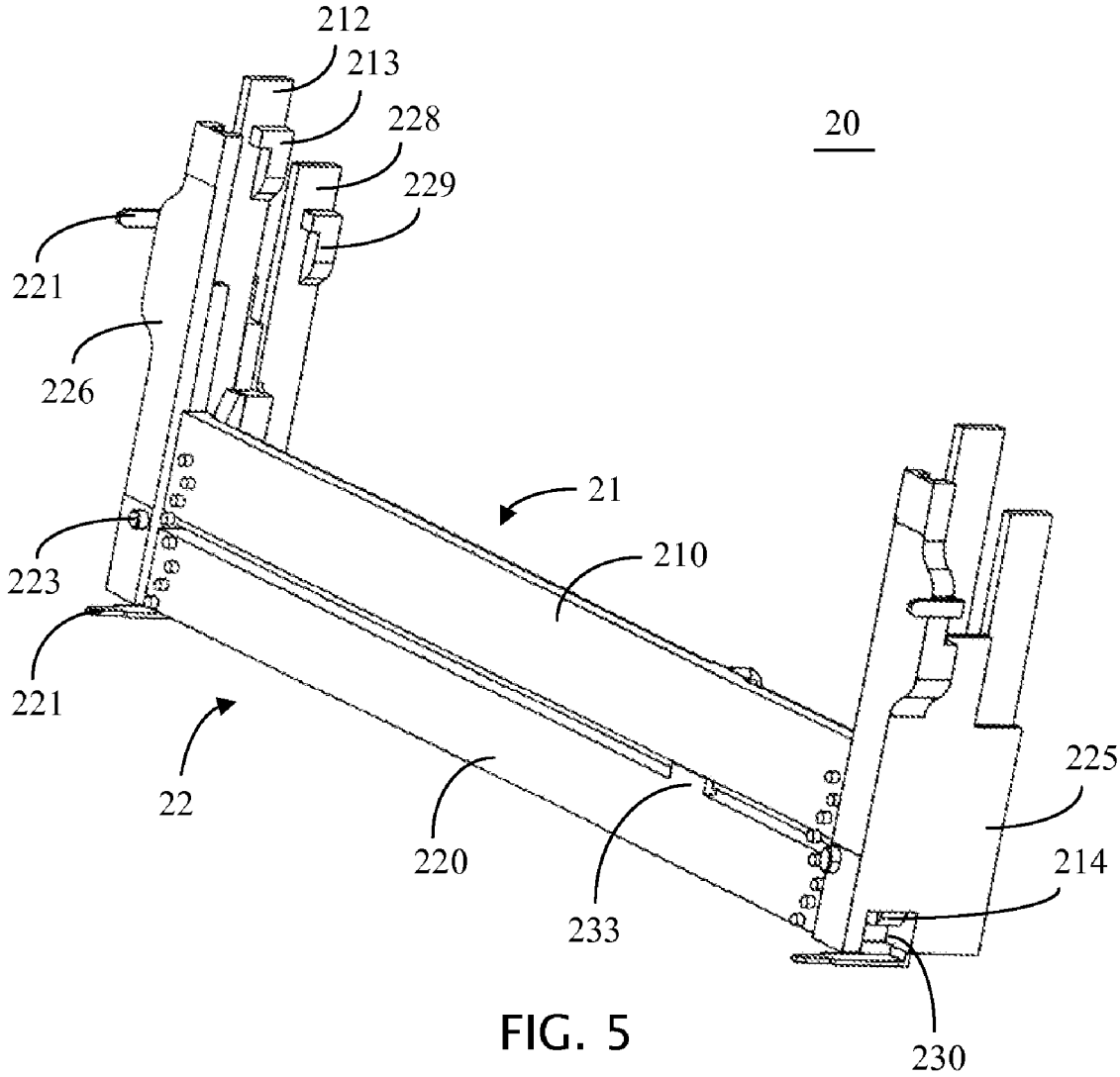
FIG. 5 is a schematic, isometric view of the multi-layered connector including the first sub-connector of FIG. 1 and the second sub-connector of FIG. 3.
Figure 6:
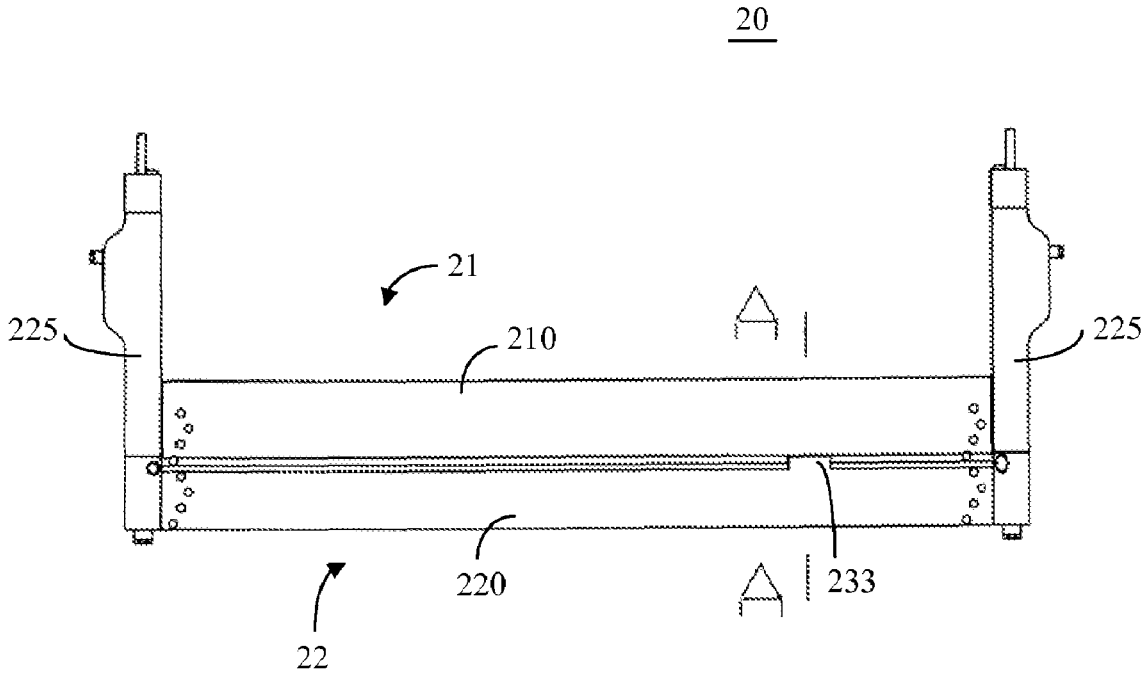
FIG. 6 is a schematic, front view of the multi-layered connector of FIG. 5.

Referring to FIGS. 3 and 4, a second sub-connector 22 of the multi-layered connector is disclosed. The second sub-connector 22 includes an elongated body 220. The elongated body 220 includes a thin top portion 231 and a thick bottom portion 223. The top portion 231 defines an elongated slot 241 (See FIG. 7) on a top surface for receiving a second semiconductor chip (not shown). The bottom portion 223 defines a protrusion 233 on a front edge of a top surface of the bottom portion 223. A plurality of tin microstructures 222 are mounted on a front surface of the bottom portion 223.

Two side arms 225 are vertically elongated from opposite ends of the body 220. Each side arm 225 defines a slide groove 224. The two slide grooves 224 are faced to each other. The slide grooves 224 are configured for receiving the first sub-connector 21. Each side arm 225 defines a recess 230 at a bottom end. The recesses 230 communicate with the slide grooves 224 and are configured for engaging with the protrusion 214 of the first sub-connector 21. An elastic piece 228 corresponding to the top portion 231 is elongated upwardly from an upper end of each side arm 225. Each elastic piece 228 includes an "L"-shaped clip 229 on an inner surface of the elastic piece 228. The two clips 229 are faced to each other. The slot 241, side arms 225, elastic pieces 228, and clips 229 are configured for holding the second semiconductor chip.

A fixing piece 226 is also elongated upwardly from an upper end of each side arm 225. A metal solder tail 221 is inserted to each fixing piece 226 or side arm 225. When the second sub-connector 22 connects with a PCB (printed circuit board), the solder tail 221 is soldered to the PCB for enforcing a connection between the second sub-connector 22 and the PCB.

Referring to FIGS. 5, 6, 7 and 8, the multi-layered connector 20 is composed of the first sub-connector 21 and the second sub-connector 22. In assembling the multi-layered connector 20, firstly, apply glue on the top surface of the bottom portion 223 to form multiple glue points 232 at positions disposed along the elongated direction of the elongated board 220. The glue points 232 are disposed evenly (see FIG. 3). Secondly, insert the two ends of the first sub-connector 21 in the two slide grooves 224 of the second sub-connector 22. Thirdly, push the first sub-connector 21 to move along the slide grooves 224 till the protrusions 214 of the first sub-connector 21 engage with the recesses 230 of the second sub-connector 22, the recess 216 of the first sub-connector 21 engages with the protrusion 233 of the second sub-connector 22, and the lower surface of the body 210 of the first sub-connector 21 contacts the glue points 232 on the top surface of the bottom portion 223 of the second sub-connector 22. After the glue is solidified, the first sub-connector 21 connects with the second sub-connector 22 firmly.

Moreover, it is to be understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A multi-layered connector comprising:

a first sub-connector comprising a first elongated body;

a second sub-connector comprising a second elongated body;

first protrusions and first recesses respectively disposed on two ends of the first sub-connector and the second sub-connector, engaging with each other for connecting the first sub-connector with the second sub-connector; and glue points for connecting the first elongated body with the second elongated body at a plurality of positions disposed along the elongated direction.

2. The multi-layered connector of claim 1, wherein the glue points are disposed evenly between the first elongated body and the second elongated body.

3. The multi-layered connector of claim 1, further comprising a second recess and a second protrusion engaged with each other, wherein the second recess is disposed in a front surface of the elongated body of the first sub-connector, the second protrusion is disposed on a top surface of the elongated body of the second sub-connector.

* * * * *